United States Patent [19]

Solomon

[11] Patent Number: 4,976,364

[45] Date of Patent: Dec. 11, 1990

[54] CAP AND STRAW ASSEMBLY FOR A WATER BOTTLE

[76] Inventor: Stanley B. Solomon, 29 Misty Acres Rd., Rolling Hills Estates, Calif. 90274

[21] Appl. No.: 472,651

[22] Filed: Jan. 30, 1990

[51] Int. Cl.[5] ..... B65D 47/24

[52] U.S. Cl. ..... 215/229; 222/211; 222/524

[58] Field of Search ..... 215/1 A, 229; 222/211, 222/523, 524; 220/90.2

[56] References Cited

U.S. PATENT DOCUMENTS

| | | | |
|---|---|---|---|
| D. 285,186 | 8/1986 | Sinyard . | |
| 605,321 | 6/1898 | Lines | 222/524 |
| 2,815,879 | 3/1955 | Hermes . | |
| 3,071,303 | 1/1963 | Pugh . | |
| 3,173,566 | 3/1965 | Talbert . | |
| 3,215,329 | 11/1965 | Pugh, Sr. . | |
| 3,220,587 | 11/1965 | Griffin et al. | 215/1 A |
| 3,325,076 | 8/1965 | Soucy . | |
| 3,425,626 | 2/1969 | Dietz et al. . | |
| 3,606,156 | 9/1971 | Homorodean, Jr. et al. . | |
| 3,623,632 | 11/1971 | Chang | 220/90.2 |
| 3,776,458 | 12/1973 | Chunga, Sr. . | |
| 3,792,798 | 2/1974 | Chang | 220/90.2 |
| 3,840,153 | 10/1974 | Devlin | 222/211 X |
| 3,851,441 | 12/1974 | Marchand | 53/116 |
| 3,874,554 | 4/1975 | Chang | 220/90.2 |
| 4,090,650 | 5/1978 | Gotta | 215/11.1 |
| 4,095,812 | 6/1978 | Rowe . | |
| 4,134,247 | 1/1979 | Sather | 220/90.2 X |
| 4,159,790 | 7/1979 | Bailey | 222/211 |
| 4,226,356 | 10/1980 | Lemelson | 220/90.2 X |
| 4,251,019 | 2/1981 | Cone | 220/90.2 X |
| 4,265,363 | 5/1981 | Conn | 215/229 |
| 4,448,316 | 5/1984 | Hiroshige | 215/1 A |
| 4,485,963 | 12/1984 | Panicci | 215/1 A X |
| 4,709,829 | 12/1987 | Johnson et al. | 220/90.2 |
| 4,798,301 | 1/1989 | Bullock et al. | 215/256 |
| 4,828,128 | 5/1989 | Tackles | 215/256 |
| 4,830,239 | 5/1989 | Tackles et al. | 224/35 |
| 4,830,240 | 5/1989 | Tackles et al. | 224/35 |
| 4,848,622 | 7/1989 | Kroetsch | 220/90.4 |

*Primary Examiner*—Donald F. Norton
*Attorney, Agent, or Firm*—Kelly Bauersfeld & Lowry

[57] ABSTRACT

An improved cap and straw assembly for use with a water bottle or the like, wherein a bottle cap of the type having a poppet valve is equipped with a drinking straw for facilitated dispensing or drinking of a beverage from the bottle. The poppet valve includes a valve member adapted for movement to a position defining an open outlet port through which the bottle contents can be dispensed. The drinking straw has an upper end carried by the cap in surrounding relation to the outlet port, and a lower end terminating within the bottle near a bottle wall thereof. When the valve member is open, the straw permits the beverage to be sucked through the straw and poppet valve, thereby permitting beverage dispensing without requiring bottle inversion.

11 Claims, 1 Drawing Sheet

CAP AND STRAW ASSEMBLY FOR A WATER BOTTLE

BACKGROUND OF THE INVENTION

This invention relates generally to improvements in water bottles of the type used to carry a supply of drinking water or other selected beverage. More particularly, the present invention relates to improvements in water bottles and related bottle caps of the type having a poppet valve which may be selectively opened to permit dispensing of the bottle contents.

Small water bottles, canteens, etc. are well known in the art for storing and carrying a supply of drinking water or other selected beverage in a manner adapted for easy portability and immediate dispensing. Such containers are useful in many different environments to provide a convenient source of rinking water or other preferred beverage which otherwise may not be readily available. By way of example, such compact water bottles have become popular with bicyclists, as referenced by the support clamps depicted in U.S. Pat. Nos. 4,830,239 and 4,830,240 for mounting such water bottles onto the frame of a bicycle. Similarly, compact water bottles are widely used by hikers, joggers, and other persons in the course of many different recreational, athletic, and/or outdoor activities.

In one common form, the water bottle comprises a compact bottle body having an upper neck defining a relatively wide mouth to permit filling with drinking water or the like. The bottle neck is adapted to receive removable cap equipped with a poppet valve. The cap closes the bottle mouth, and the poppet valve includes a valve member movable between open and closed positions for respectively permitting or preventing beverage dispensing. In this regard, a standard or typical poppet valve known in the art comprises an upright cylindrical body formed integrally with and extending through the bottle cap to define an outlet port, in combination with a reciprocal valve member therein to open and close the outlet port. Beverage dispensing is normally accomplished by inverting and draining the bottle contents. Alternatively, with a plastic bottle formed from a lightweight and deformable plastic material, the beverage can be partially dispensed by squeezing the bottle body to force the contents upwardly through the poppet valve.

Unfortunately, in some environments of use, bottle inversion for dispensing purposes can be undesirable. As one example, a bicyclist or jogger must divert his attention from the road at least momentarily in order to drink from an inverted bottle. Similarly, bottle inversion with its inherent requirement of bottle elevation can be especially undesired in military combat situations. The use of a squeeze type bottle does not satisfactorily remove the disadvantages associated with bottle inversion, since a squeeze bottle still requires inversion for dispensing unless the bottle is in a subsequently full condition.

In the past, many beverage containers have been proposed to include a drinking straw which can be used for beverage dispensing without requiring container inversion. In some instances, the drinking straw is integrated with disposable container packaging for insertion into the container when opened. In other cases, the drinking straw is preinstalled loosely within the container for access and use when the container is opened. In still other designs, a customized and typically complex valve structure carries a straw or multiple straw segments for use when the container is opened. However, such previous arrangements have not been adapted for simple and cost-efficient integration with a standard or typical poppet valve of the type described above and commonly employed with modern compact water bottles.

There exists, therefore, a significant need for an inexpensive and simple valve and straw combination for use with compact water bottles, canteens, etc., wherein substantially the entire contents of the water bottle may be dispensed when the valve is opened without requiring bottle inversion. The present invention fulfills these needs and provides further related advantages.

SUMMARY OF THE INVENTION

In accordance with the invention, an improved cap and straw assembly is provided for use with a water bottle of the type adapted for storing and carrying a small supply of drinking water or other selected beverage. The improved cap and straw assembly includes a poppet valve of standard construction in combination with a drinking straw, and is adapted for relatively easy dispensing of substantially the entire contents of the water bottle without requiring bottle inversion.

In the preferred form, the cap and straw assembly is designed for use with a water bottle having a compact bottle body with an upper neck defining a relatively wide or open mouth. The bottle cap is designed to mount onto the bottle neck in a position closing the mouth. The poppet valve is carried by the cap and includes a valve member mounted for movement between open and closed positions for respectively permitting and preventing dispensing of the bottle contents. The drinking straw has an upper end supported by the bottle cap in a position surrounding a lower end of the poppet valve, and a length to extend downwardly from the bottle cap to a position substantially adjacent a bottom end wall of the bottle body. When the poppet valve is open, the contents of the bottle can be drawn by sucking through the straw and further through an outlet port defined by the poppet valve, all in a manner which does not require bottle inversion. Alternately, the contents may be dispensed by squeezing the bottle.

The poppet valve comprises a generally cylindrical and upright valve body formed integrally with the bottle cap along a substantially vertical central cap axis. The movable valve member comprises a generally cylindrical poppet sleeve received within the valve body and adapted for movement along a valve stem between a closed lower position and an open upper position. In this regard, a lower end of the valve body is formed by a plurality of spaced support legs which extend downwardly beneath the cap onto the bottle interior and support a valve seat disk for engagement by the lower end of the poppet sleeve when said poppet sleeve is in the lower, closed position. Lifting of the poppet sleeve from the valve seat disk defines an open outlet port permitting fluid flow from the bottle interior through the interior of the poppet sleeve to the exterior of the bottle.

The bottle cap is further structured to define one or more annular flanges extending downwardly from the bottle cap in circumscribing relation to the valve body of the poppet valve. This annular flange or flanges are positioned for seated support of the drinking straw by press-fit mounting or the like. Accordingly, when the poppet valve is open, liquid flow to the poppet valve from the bottle interior is confined for passage through the drinking straw, with the lower end of the drinking straw opening into the bottle body at a position in closely spaced relation with the bottom end wall thereof. The contents of the bottle can thus be dispensed by squeezing the bottle body or by sucking on the portion of the valve body located above the cap to draw the bottle contents through the cap and poppet valve, all without bottle inversion.

Other features and advantages of the present invention will become more apparent from the following detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
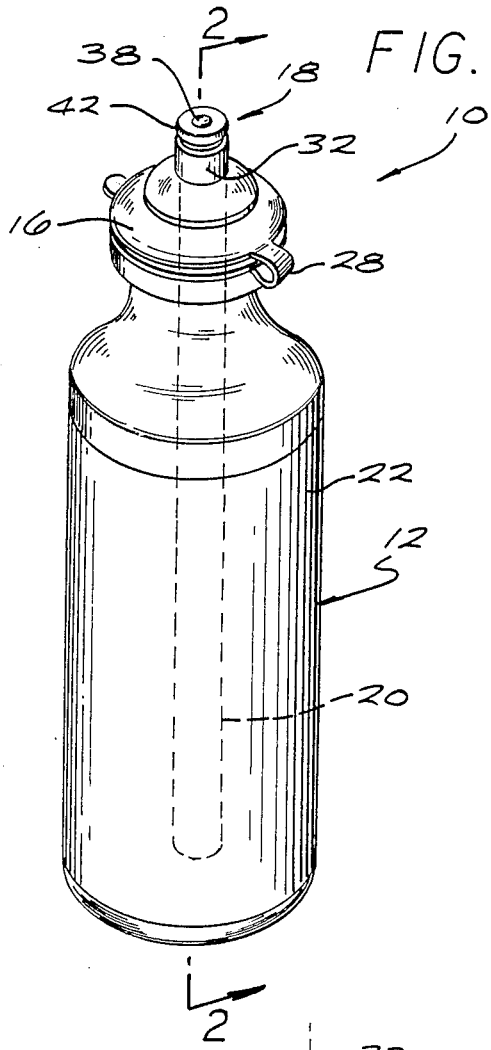
FIG. 1 is a perspective view illustrating a water bottle equipped with an improved cap and straw assembly embodying the novel features of the invention.

As shown in the exemplary drawings, an improved cap and straw assembly referred to generally by the reference number 10 is provided for use with a water bottle 12 of the type adapted for receiving and carrying a supply of drinking water 14 or other selected beverage. The cap and straw assembly 10 includes a bottle cap 16 equipped with a standard poppet valve 18, in combination with an internally mounted drinking straw 20. The poppet valve 18 and drinking straw 20 cooperatively permit the bottled contents to be dispensed substantially completely without requiring bottle inversion.

Figure 2:
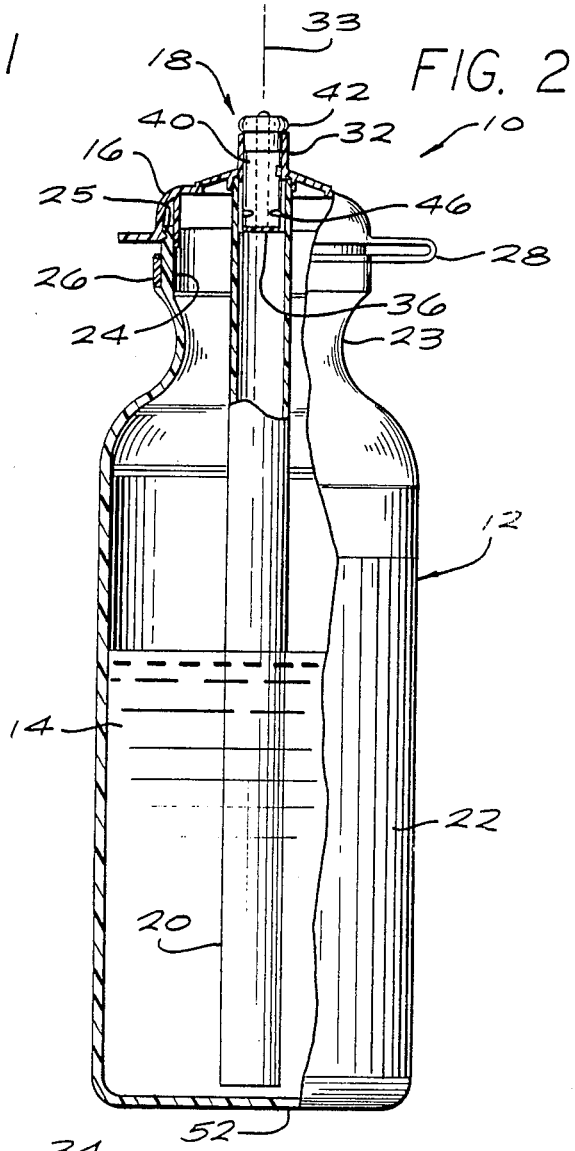
FIG. 2 is a partially fragmented vertical sectional view taken generally on the line 2—2 of FIG. 1, and illustrating a poppet valve in a closed position.
Figure 3:
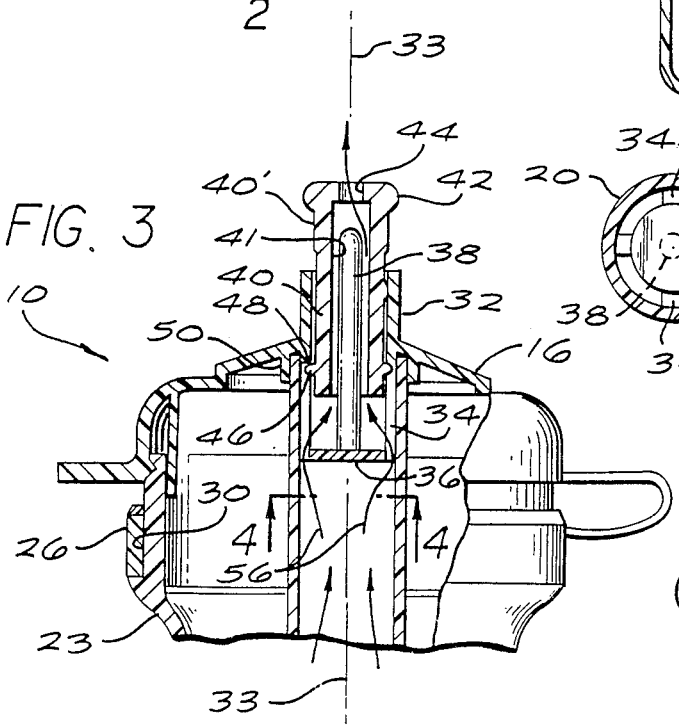
FIG. 3 is an enlarged fragmented vertical sectional view similar to an upper portion of FIG. 2, but illustrating the poppet valve in an open position.

The overall construction of the illustrative water bottle 12 is generally known in the art, to include a lower bottle body 22 formed typically from a lightweight molded plastic to have a selected size and shape. The bottle body 22 defines an upper neck 23 forming a relatively wide or open mouth 24 which is normally covered and closed by the bottle cap 16. In this regard, FIGS. 1–3 depict a lightweight bottle cap of molded plastic material similar to the bottle body construction and having an internal snap rib 25 for snap-fit mounting onto the bottle neck 23 in a removable manner. A support ring 26 is attached to the bottle cap 16 by a flexible web 28, and the support ring is adapted for seated reception within an external channel 30 formed about the bottle neck 23 to prevent inadvertent separation of the bottle cap 16 from the bottle. Alternately, it will be understood that other cap configurations may be used, such as thread-on caps, etc. Moreover, it will be understood that the specific bottle shape and material may vary widely, with a lightweight and deformable plastic construction being preferred for many applications.

Figure 4:
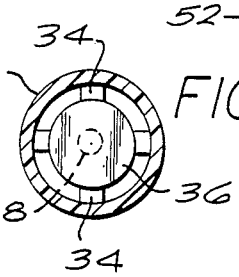
FIG. 4 is an enlarged horizontal sectional view taken generally on the line 4—4 of FIG. 3.

As shown best in FIGS. 2–4, the poppet valve 18 is centrally mounted on the bottle cap 16 in a position extending along a central vertical cap axis 33. The poppet valve 18 comprises a generally cylindrical and hollow valve body 32 which is preferably formed integrally with the cap 16 to extend upwardly from the cap at least a short distance. Beneath the cap 16 the cylindrical valve body 32 merges with a circumferentially spaced plurality of support legs 34 which protrude downwardly from the cap in parallel relation to each other and substantially in the form of continuations of the valve body structure. The lowermost ends of these support legs 34 are joined in turn to a generally circular valve seat disk 36. As shown best in FIG. 3, the valve seat disk 36 is thus spaced below the underside of the bottle cap 16, with the spacing between the support legs 34 cooperating with the interior of the valve body 32 to define an outlet port for exit passage of the water or the like within the bottle. While the illustrative drawings show a total of four symmetrically arranged support legs 34 (FIG. 4), it will be understood that other numbers of spaced support legs may be used.

The poppet valve 18 further includes a valve guide stem 38 mounted within the valve body 32 to extend generally along the axis 33. This guide stem 38 is supported by and upstands from the valve seat disk 36 and terminates at an upper blunt tip disposed at least slightly above the uppermost margin of the valve body 32 (FIG. 3). A cylindrical poppet sleeve 40 of molded plastic or the like fits snugly into the valve body 32 for vertical reciprocatory motion along the stem 38 to open and close the poppet valve to water flow.

More particularly, the poppet sleeve 40 defines an internal bore 41 sized for relatively free sliding motion about the guide stem 38, and an external diameter sized for relatively snug yet sliding fit into the valve body 32. An axially lower end of the poppet sleeve 40 is adapted to seat upon the valve seat disk 36 when the poppet sleeve is pushed downwardly into the valve body toward a lower position as viewed in FIG. 2. In this lower position, the poppet sleeve substantially closes the valve by blocking fluid flow between the support legs 34 to the interior of the valve body 32. The effectiveness of this sealing action is enhanced by forming a radially enlarged flange 42 at the upper end of the poppet sleeve to seat upon the upper end of the valve body. In addition, a slightly enlarged upper region 40' (FIG. 3) of the poppet sleeve may be formed for press-fit into the valve body, and an exit port 44 in the upper end of the poppet sleeve fits snugly over the blunt upper end of the guide stem.

The poppet valve 18 is opened by lifting the poppet sleeve 40 within the valve body 32, as viewed in FIG. 3. In this upper or open position, the lower end of the sleeve 40 is spaced above the valve seat disk 36 to permit fluid to flow between the support legs 34 and upwardly through the poppet sleeve 40 by virtue of the substantial clearance between the poppet sleeve and the valve guide stem 38. This fluid flow may continue through the exit port 44 in the poppet sleeve. Conveniently, detent tabs 46 near the lower end of the poppet sleeve 40 engage the underside of the bottle cap 16 for normally preventing poppet sleeve removal from the bottle cap.

In accordance with the improvements provided by the present invention, the bottle cap 16 is adapted to receive and support the drinking straw 20, such that the poppet valve 18 and straw 20 cooperatively accommodate water dispensing without requiring bottle inversion. In the preferred form as depicted best in FIGS. 2–4, the bottle cap includes at least one and preferably two depending annular flanges 48 and 50 which concentrically enclose or circumscribe the lower end of the poppet valve at the underside of the bottle cap. FIG. 3 depicts the internal annular flange 48 formed as a short continuation of the valve body 32 for press-fit engagement into the upper end of the drinking straw 20. FIG. 3 further depicts the outer annular flange 50 formed concentrically about the inner flange 48, such that the drinking straw may be press-fit between these flanges 48 and 50 for secure anchoring. Alternately, if desire, the drinking straw 20 may be anchored by other means, such as by an appropriate adhesive or the like.

In use, when the poppet valve 18 is opened by upward displacement of the poppet sleeve 40, a person may draw the contents of the bottle through the drinking straw 20 and further through the poppet valve 18 by sucking in the manner of a conventional drinking straw. The upwardly protruding valve body 32 is conveniently exposed above the cap 16 and thus provides an effective continuation of the straw 20 for easy access to the person drinking from the bottle. A lower end of the drinking straw 20 is positioned in relatively closely spaced relation with a bottom end wall 52 of the bottle body, such that the straw is open to the bottle contents and permitting substantially the entire contents to be dispensed without bottle inversion. Sucking action pulls the water upwardly through the straw 20 and into the poppet valve through the arcuate spaces defined by the support legs 34. This flow of water is illustrated in FIG. 3 by arrows 56, with the water passing further upwardly through the poppet valve to the bottle exterior. Alternately, the close proximity of the straw lower end to the bottle end wall 52 permits substantially the entire bottle contents to be dispensed by squeezing the upright bottle body, if desired.

Figure 5:
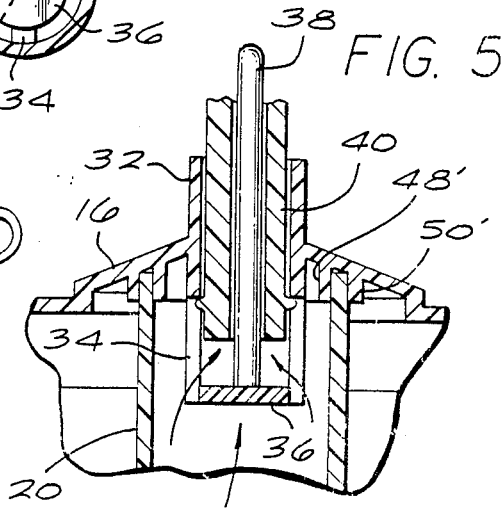
FIG. 5 is an enlarged fragmented vertical sectional view depicting one alternative preferred form of the invention.

In one alternative form of the invention, as viewed in FIG. 5, modified annular flanges 48' and 50' may be formed in radially outward spaced relation to the poppet valve. In this construction, when the poppet valve is open, substantially greater passage area is provided for liquid flow through the straw and poppet valve during dispensing.

A variety of further modifications and improvements to the present invention will be apparent to those skilled in the art. Accordingly, no limitation on the invention is intended by way of the foregoing description and accompanying drawings, except as set forth in the appending claims.

What is claimed is:

1. A bottle cap and straw assembly for mounting onto a bottle body adapted to contain a selected liquid beverage, said assembly comprising:

a bottle cap having an upper side and a lower side and being adapted for mounting onto the bottle body with said lower side presented in a direction toward the interior of the bottle body;

a poppet valve carried by said cap and including a valve member accessible from said upper side of said cap for manual movement between open and closed positions for respectively permitting and preventing beverage passage through an outlet port defined by said poppet valve;

a drinking straw; and means for mounting said straw onto said cap with one end of said straw generally circumscribing said poppet valve at said lower side of said cap and with said straw extending from said lower side of said cap into the interior of the bottle body when said cap is mounted onto the bottle body, such that the beverage within the bottle body can be drawn by sucking through said straw and said poppet valve when said valve member is in the open position.

2. The assembly of claim 1 wherein said poppet valve comprises a generally cylindrical valve body projecting upwardly from said upper side of said cap, a plurality of circumferentially spaced support legs projecting downwardly from said lower side of said cap, a valve seat disk supported by said support legs in spaced relation below said lower side of said cap, and said valve member comprising a poppet sleeve received slidably within said valve body and movable between said closed position seated upon said valve seat disk and said open position is spaced relation with said valve seat disk to permit flow between said support legs to the upper side of said cap through said poppet sleeve.

3. The assembly of claim 2 wherein said mounting means comprises at least one annular flange formed on said lower side of said cap in surrounding relation with said poppet valve, said flange being engageable with said one end of said straw.

4. The assembly of claim 3 wherein said flange is press-fit with said straw.

5. The assembly of claim 3 wherein said at least one flange comprises a pair of concentric annular flanges adapted to receive therebetween said one end of said straw.

6. The assembly of claim 5 wherein said one end of said straw is press-fit engageable between said pair of flanges.

7. The assembly of claim 5 wherein said pair of flanges are radially outwardly spaced from said poppet valve.

8. A bottle cap and straw assembly, comprising;

a bottle cap having an upper side and a lower side;

a poppet valve carried by said bottle cap, said poppet valve comprising a generally cylindrical valve body projecting upwardly from said upper side of said cap, a plurality of circumferentially spaced support legs projecting downwardly from said lower side of said cap, a valve seat disk supported by said support legs in spaced relation below said lower side of said cap and a poppet sleeve received slidably within said valve body and movable between a closed position seated upon said valve seat disk and an open position spaced from said valve seat disk;

a drinking straw; and means for mounting said straw onto said cap with one end of said straw generally circumscribing said poppet valve at said lower side of said cap and with said straw extending from said lower side of said cap, said mounting means including at least one annular flange formed on said lower side of said cap in surrounding relation with said poppet valve, said flange being engageable with said one end of the said straw.

9. The assembly of claim 8 wherein said flange is press-fit engageable with said straw.

10. A water bottle, comprising:

a bottle body having an upper neck defining an open mouth for receiving a selected beverage into the interior of the bottle body;

a bottle cap having an upper side and a lower side and being adapted for mounting onto the bottle body with said lower side presented in a direction toward the interior of the bottle body;

a poppet valve carried by said cap and including a valve member accessible from said upper side of said cap for manual movement between open and closed positions for respectively permitting and preventing beverage passage through an outlet port defined by said poppet valve;

a drinking straw; and means for mounting said straw onto said cap with one end of said straw generally circumscribing said poppet valve at said lower side of said cap and with said straw extending from said lower side of said cap into the interior of the bottle body when said cap is mounted onto the bottle body, such that the beverage within the bottle body can be drawn by sucking through said straw and said poppet valve when said valve member is in the open position;

said bottle body defining a bottom wall and said straw having a second end disposed adjacent said end wall when said cap is mounted on said bottle body.

11. The water bottle of claim 10 wherein said bottle body is formed from a deformable squeezable material.

* * * * *